United States Patent [19]

Dietrich et al.

[11] Patent Number: 4,612,905

[45] Date of Patent: Sep. 23, 1986

[54] FUEL INJECTION APPARATUS

[75] Inventors: Werner Dietrich, Heppenheim; Richard Kinzel, Bensheim, both of Fed. Rep. of Germany

[73] Assignee: Motoren-Werke Mannheim AG, vorm. Benz Stat. Motorenba, Mannheim, Fed. Rep. of Germany

[21] Appl. No.: 159,921

[22] Filed: Jun. 16, 1980

[30] Foreign Application Priority Data

Jan. 26, 1980 [DE] Fed. Rep. of Germany ..... 3002851
Mar. 25, 1980 [DE] Fed. Rep. of Germany ..... 3011376

[51] Int. Cl.[4] ..... F02M 39/00
[52] U.S. Cl. ..... 123/575; 123/300
[58] Field of Search ..... 123/575, 576, 577, 578, 123/299, 300

[56] References Cited

U.S. PATENT DOCUMENTS

| | | | |
|---|---|---|---|
| 2,173,813 | 9/1939 | Bischof | 123/300 |
| 3,690,768 | 9/1972 | Nagasawa | 123/300 |
| 4,013,055 | 3/1977 | Sommer | 123/501 |
| 4,224,903 | 9/1980 | Mowbray | 123/300 |
| 4,273,087 | 6/1981 | Goloff | 123/575 |

FOREIGN PATENT DOCUMENTS

| | | | |
|---|---|---|---|
| 851570 | 10/1952 | Fed. Rep. of Germany | 123/300 |
| 1576478 | 1/1970 | Fed. Rep. of Germany | 123/300 |

*Primary Examiner*—Carl Stuart Miller
*Attorney, Agent, or Firm*—Browdy and Neimark

[57] ABSTRACT

A fuel injection system, especially for Diesel engines using relatively hard-to-ignite fuels. The system includes a low pressure pump for delivering an easily ignitable fuel into a pre-storage chamber within a pressure divider. A high-pressure pump delivers the main fuel component and also applies pressure to an expulsion piston which expels the prestored igniter fuel. A number of embodiments is presented.

13 Claims, 7 Drawing Figures

FUEL INJECTION APPARATUS

FIELD OF THE INVENTION

The invention relates to an apparatus for injecting fuel, especially difficult-to-ignite fuel for Diesel engines.

BACKGROUND OF THE INVENTION

In conventional Diesel combustion processes, the requirements for low specific fuel consumption and for low toxic emissions oppose each other. However, operation of Diesel engines with two types of fuel makes it possible to fulfill both requirements at the same time. Another advantage of dual fuel operation consists in the fact that a considerable portion of the Diesel fuel can be replaced by alternative fuels, such as, for example, alcohols derived from vegetative materials, particularly ethanol.

Alcohols are distinguished by having extremely low cetane numbers. This signifies a low ignition propensity, so that these fuels cannot be burned in Diesel engines without taking further steps. The reason for this characteristic of alcohols and, particularly, of ethanol, is the substantially higher ignition temperature of alcohols compared to normal Diesel fuel. In addition, the heat of vaporization of ethanol is more than three times as high as that of Diesel fuel.

Various methods have already been used to increase the compression temperatures so as to prevent ignition failures when using ethanol in Diesel engines. Among these are: increasing the compression ratio, throttling and pre-heating the intake air, using exhaust gas recirculation and high temperature cooling. Investigations have shown that any single measure of the above cited kind does not suffice to guarantee partial load operation without ignition failures. Taking additional steps to aid in cold starting requires expensive controls and is too difficult for practical operation.

To avoid these disadvantages, it has already become known to add ethanol to the intake air through the carburetor or by low-pressure injection, i.e. to mix ethanol and air externally. Ignition then takes place after high-pressure injection of ordinary Diesel fuel. It was found that the percentage of ethanol could not be increased beyond 25% to 40% of the total fuel quantity, because knocking occured.

However, the percentage of ethanol could be increased substantially by two-fuel operation of the kind cited above, i.e. where alcohol and conventional Diesel fuel were injected into the combustion chamber of the cylinder by means of completely separate, high-pressure injection systems. However, this improvement was offset by the disadvantage of requiring two expensive high-pressure injection systems.

The German Federal Republic Offenlegungsschrift (Laid Open Patent Application) No. 15 76 478 describes a fuel injection valve, which makes possible a two-stage injection process of the same Diesel fuel into the combustion chamber of a cylinder. Such pre-injection tends to reduce the combustion noises of Diesel engines and provide relatively smoke-less combustion. The opening pressure for the main injection is greater than the opening pressure for the pre-injection, in order to obtain a distinct separation between the two injection processes.

OBJECT AND SUMMARY OF THE INVENTION

It is therefore an object of the present invention to provide a fuel injection apparatus of the above-identified kind which makes possible separate injection of igniter fuel and main fuel into the combustion chamber of the cylinder of a Diesel engine without requiring two separate high pressure systems and without requiring a significant modification of the Diesel engine.

This object is attained, according to the invention, by providing a fuel injection apparatus including a high-pressure fuel pump for injection of the main fuel component and a second fuel pump for the igniter component. Each pump feeds an injection nozzle which opens when the proper injection pressure is reached.

According to the invention, the second pump is a low-pressure pump having a pre-storage chamber in a pressure divider, associated with an expulsion piston which is subjected to the main fuel pressure.

A principal feature of the invention is the fact that only one high-pressure pump is required to inject the hard-to-ignite main fuel component, i.e., in general, the alcohol, while the igniter fuel component is supplied by a low-pressure pump and is pre-stored ahead of the main fuel component whose high pressure is then used to inject the igniter fuel. The igniter fuel is pre-stored in a pressure distributor, which can be attached either to the high pressure injection pump or to one of the injection nozzles, especially to the main fuel nozzle.

The injection points of the igniter fuel and of the hard-to-ignite main fuel can be separated in time by making the expulsion piston part of a differential piston and giving it a smaller cross-section than the piston which is subjected to main fuel pressure.

An advantageous feature of the invention provides that the pre-storage chamber has a pressure-relief valve and the high-pressure pump is driven by compound cams. The first stage of a two-stage cam raises the main fuel pressure until the igniter fuel is injected, while the main injection nozzle remains closed. The stroke of the expulsion piston may be adjusted so that the quantity of easy-to-ignite fuel can be matched to different load and rpm conditions of the engine, and thus to different conditions of combustion.

Further advantages and features of the invention will emerge from the following description of exemplary embodiments related to the drawing.

THE DRAWING

DESCRIPTION OF THE PREFERRED EMBODIMENTS

Figure 1:
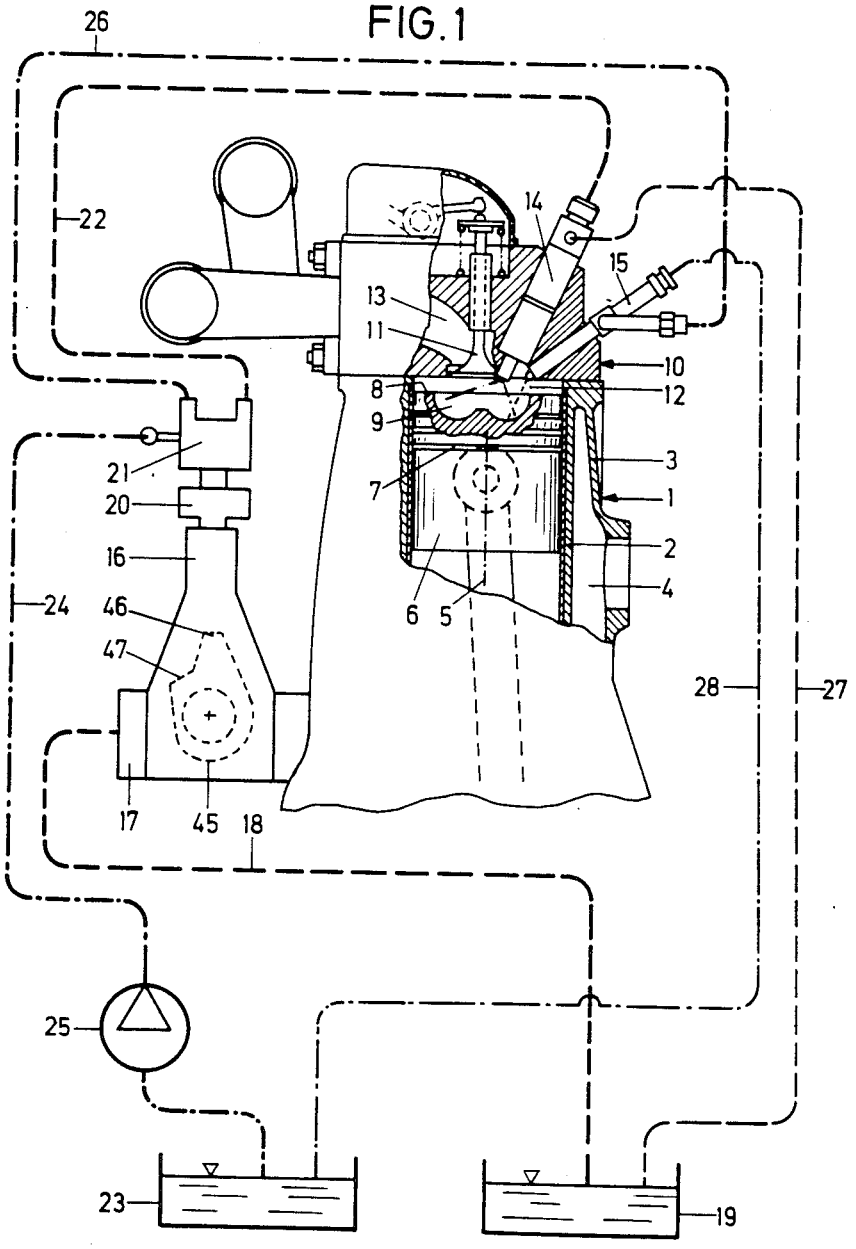
FIG. 1 is a schematic illustration of the apparatus according to the invention in which the pressure divider is attached to the high pressure injection pump.

FIG. 1 depicts the upper part of the crankcase/engine block 1 of a Diesel engine. A cylinder sleeve 2 of a cylinder 3 is situated in the block 1.

Cooling water channels 4 are located within the cylinder 3 between the sleeve 2 and the exterior of the cylinder. A piston 6 movable along its central axis 5 is located in the cylinder sleeve 2, and is sealed relative to the cylinder sleeve 2 in a conventional manner by piston rings 7. The piston face 8 includes an indentation 9.

The cylinder 3 is closed off by a cylinder head 10 containing an intake valve 11. The intake valve 11 connects the combustion chamber 12 bounded by the cylinder head 10, and the piston face 8, with an intake channel 13 which penetrates the cylinder head 10 for the supply of combustion air when the valve is open. When the intake valve 11 is closed, it separates the combustion chamber from the intake channel. An injection nozzle 14 is located in the cylinder head and serves for direct injection of a hard-to-ignite fuel into the combustion chamber 12, i.e. into the indentation 9 in the piston face 8. The injection nozzle 14 will henceforth be referred to as the alcohol nozzle 14.

A further injection nozzle 15 is located in the cylinder head, for injecting an easy-to-ignite fuel directly into the combustion chamber 12. The injection nozzle 15 will henceforth be referred to as the igniter nozzle 15.

Located at the side of the engine block 1 is an injection pump 16, whose suction side 17 is connected through a suction line 18 to a container 19 for storing the hard-to-ignite fuel, i.e. usually alcohol. A pressure divider 21 which will be explained more fully below, is attached to the pressure side 20 of the injection pump 16, while a main fuel pressure line 22 leads from the pressure divider to the alcohol nozzle 14.

A storage container 23 holding the easily ignited fuel, i.e. usually conventional Diesel fuel, is connected to the pressure divider 21 via a feed line 24 containing a low-pressure pump 25. The igniter fuel transported to the pressure divider 21 by the supply line 24 passes from the pressure divider to the igniter nozzle 15 through an igniter fuel line 26. Leak lines 27, 28 connect the two injection nozzles 14, 15 to respective storage containers 19, 23.

In the drawing the lines 18, 22, 27 carrying the hard-to-ignite main fuel are represented by dashed lines, whereas the lines 24, 26, 28 carrying the igniter fuel are represented by dot-dashed lines.

Figure 2:
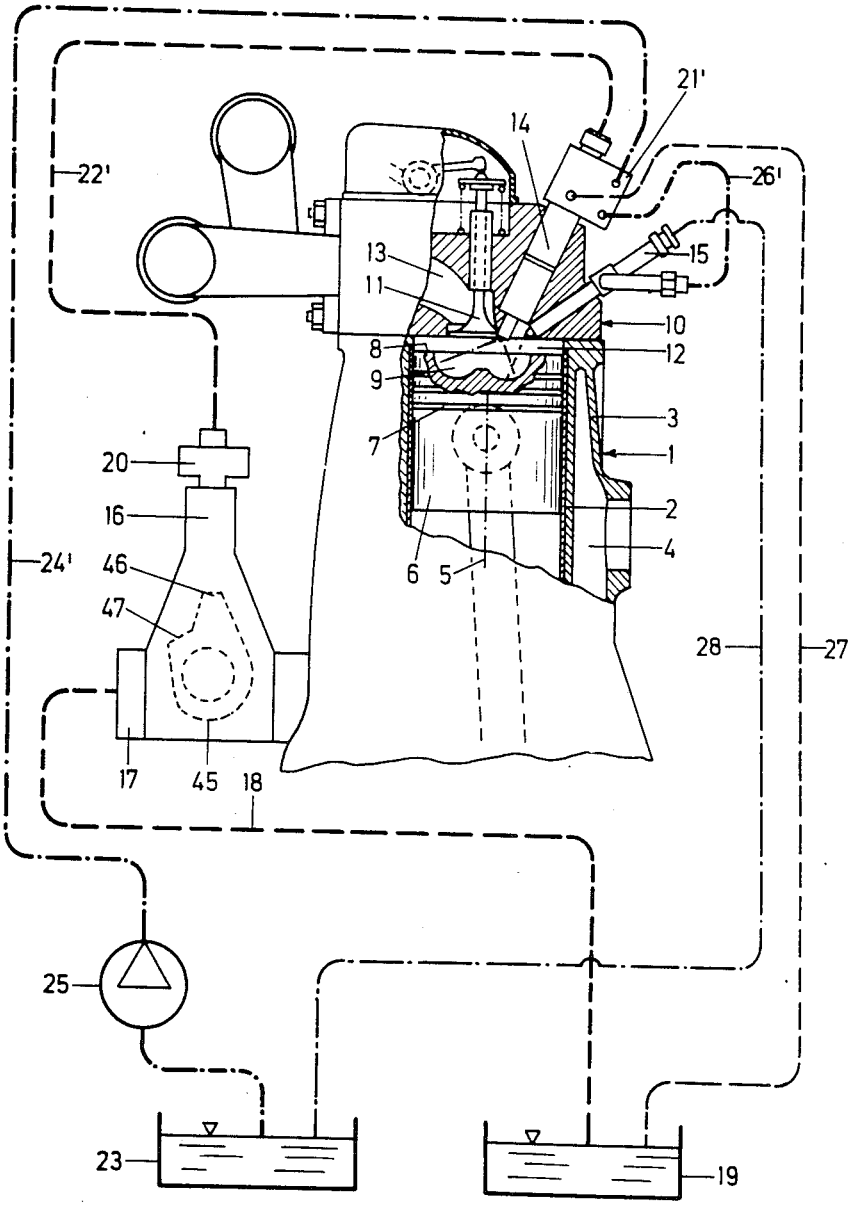
FIG. 2 is a schematic illustration of another embodiment of the invention in which pressure divider is attached to an injection nozzle.

The embodiment according to FIG. 2 differs from that according to FIG. 1 only in that a pressure divider 21' is attached to the alcohol nozzle 14'. The pressure line 22' leads directly from the pressure side 20 of the injection pump 16 to the pressure divider 21', the supply line 24' leads from the storage container 23 to the pressure divider 21', and an igniter fuel pressure line 26' leads from the pressure distributor to the igniter nozzle 15. Reference numerals which are the same in FIGS. 1 and 2 signify identical elements.

Figure 3:
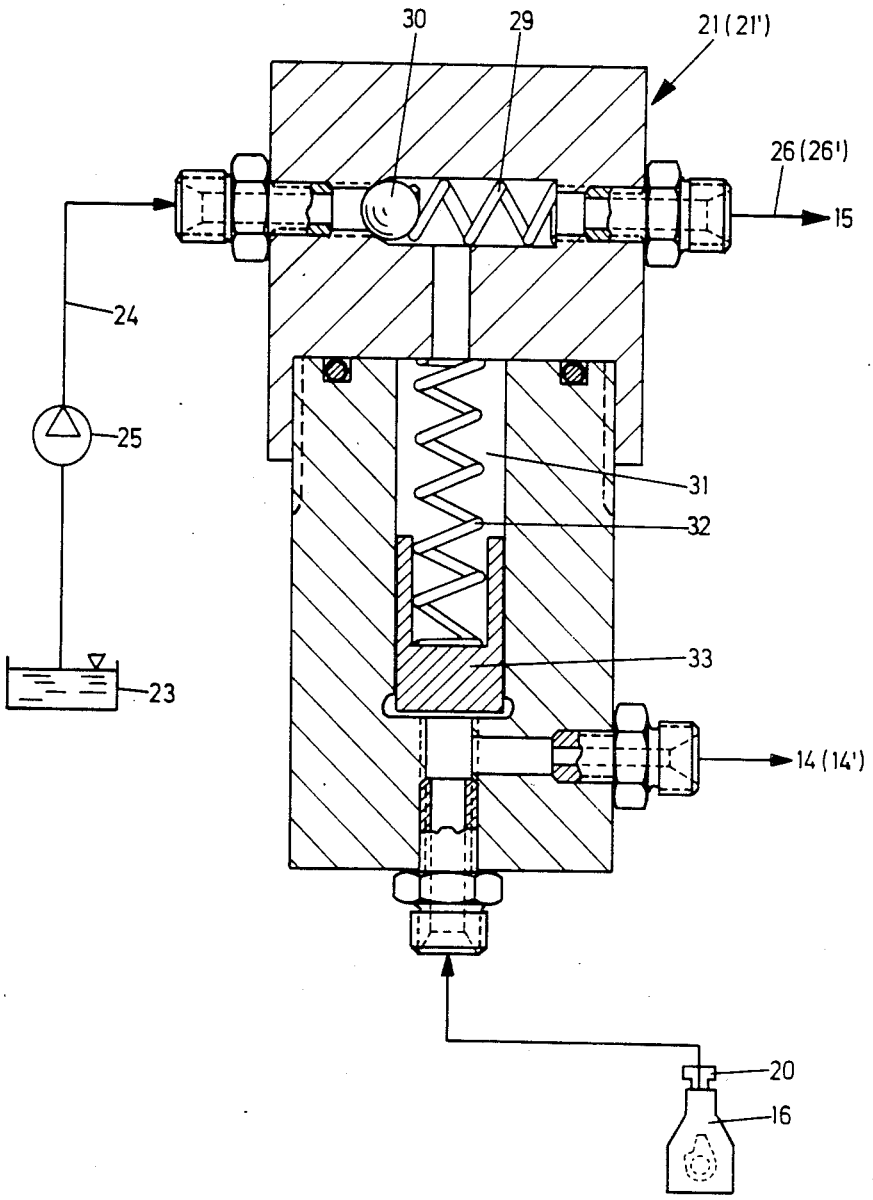
FIG. 3 shows an embodiment of a pressure divider.

FIG. 3 shows a pressure divider 21 (or 21'), which can be attached either at the pressure side 20 of the injection pump 16, or to the corresponding injection nozzle, i.e. in general at the alcohol nozzle 14, (or 14'). In such a pressure divider, the easily ignited fuel is pre-stored at low pressure and is then injected with the aid of the high pressure of the main fuel coming from the injection pump 16.

The igniter fuel is transported by the low-pressure pump 25 to the pressure divider 21, (or 21'), via the supply line 24. When the static pressure of the main fuel, i.e. of the alcohol, is lower than the pressure in the supply line 24, a check valve 30 biased by a spring 29 opens, and permits the igniter oil to flow into a pre-storage chamber 31. The chamber 31 is cylindrical and is closed off by an expulsion piston 33 displaceable therein against a spring 32. The end of the expulsion piston 33 remote from the pre-storage chamber 31 is subjectable to the pressure of the main fuel coming from the pressure side 20 of the injection pump 16. The pre-storage chamber 31 is connected to the igniter oil nozzle 15 through the igniter nozzle pressure line 26, (or 26'). The connection to the alcohol nozzle 14, (or 14'), is located ahead of the expulsion piston 33.

As already mentioned, the check valve 30 opens when the (low) pressure in the supply line 24 is greater than the static pressure in the line system for the main fuel. Igniter fuel then flows into the pre-storage chamber 31, and the expulsion piston 33 assisted by the force of the spring 32, is pushed into its end position shown in the drawing. Pre-storage may also take place in opposition to the force of a spring, because a satisfactory filling of the corresponding pre-storage chamber is guaranteed. When, due to the high pressure supply of the main fuel by the injection pump 16, the expulsion piston 33 is subjected to a correspondingly high pressure, the check valve 30 closes and the igniter fuel present in the pre-storage chamber 31 passes through the line 26, (or 26'), to the igniter oil nozzle 15. The sequence of arrival of igniter oil and main fuel (alcohol) in the combustion chamber 12 of the cylinder 2 is determined, in this exemplary embodiment, by the relative opening pressures of the igniter oil nozzle 15 and the alcohol nozzle 14 (or 14'). When the opening pressure of the igniter oil nozzle 15 is lower than that of the alcohol nozzle 14 (or 14'), the igniter oil nozzle opens before the alcohol nozzle. If the opening pressures are approximately equal, the two nozzles 15 and 14 (or 14') open approximately simultaneously. If the opening pressure of the igniter oil nozzle 15 is greater than that of the alcohol nozzle 14 (or 14'), the igniter oil nozzle opens last, with the result that the igniter oil is injected into the combustion chamber 12 only when the main fuel has already been at least partially injected.

Figure 4:
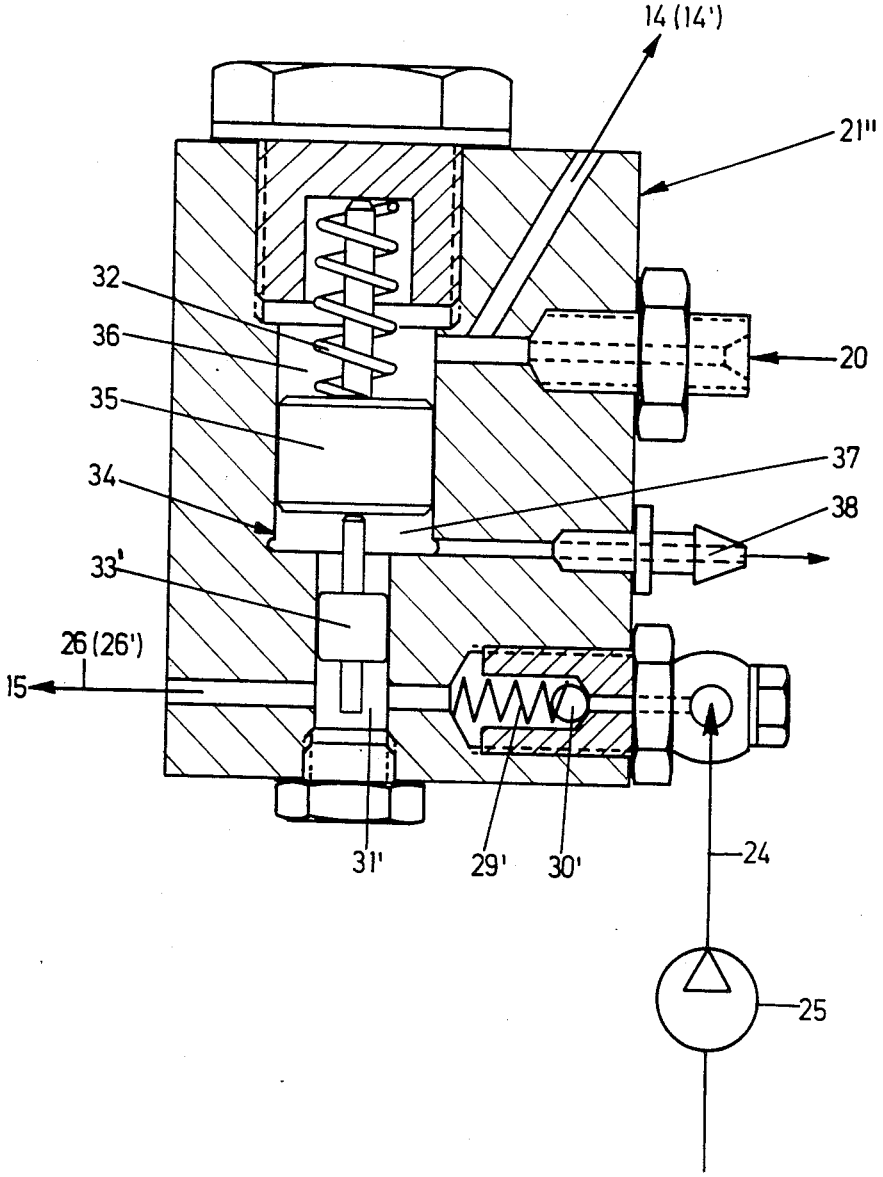
FIG. 4 shows a further embodiment of a pressure divider with a differential piston.

FIG. 4 shows a pressure divider 21'' which can likewise be coupled directly to the injection pump 16 or to the alcohol nozzle 14 or 14'. With this pressure divider, the easily ignited fuel supplied by the low-pressure pump 25 is also conducted to the pre-storage chamber 31' via a check valve 30' biased by a spring 29'. The chamber 31' is once again connected to the igniter oil nozzle 15 through an igniter oil pressure line 26 or 26'. The pre-storage chamber 31' is closed by an axially displaceable expulsion piston 33', which forms the small piston of a differential piston assembly 34. As illustrated, the piston 35 of the differential piston assembly 34 having the larger cross-sectional area relative to the expulsion piston 33' is disposed coaxially with respect to the piston 33' and contacts the expulsion piston 33'. If desired, the piston 35'' may be connected to the expulsion piston 33'.

The piston 35 is located in a cylindrical pressure chamber 36 matched to the cross sectional dimension of the piston. The chamber 36 is connected at its end remote from the expulsion piston 33' to the pressure side 20 of the injection pump 16. In this embodiment too, the spring 32 can be so oriented as to assist the effect of the pre-storage pressure. The large piston 35 is also pre-tensioned on this side by a spring 32. A shared leak oil line 38 leads out of the chamber 37 located between the large piston 35 and the expulsion piston 33'. In addition, an outlet line leads from the pressure system to the alcohol nozzle 14 or 14'. The different cross sectional surfaces of the piston 35 and of the expulsion piston 33' result in a pressure translation ratio which corresponds to the ratio of the effective areas of the pistons 33' and 35. When the pressure in the alcohol system is low, the pre-storage pressure of the low pressure pump 25 is able to open the check valve 30' and fill the pre-storage chamber 31' with igniter oil while the differential piston 35 is displaced against the pressure of the alcohol and the pre-tension of the spring 32. When the pressure chamber 36, and thus also the surface of the large piston 35 facing the chamber 36, are subjected to the high pressure of the alcohol from the pressure side 20 of the injection pump, a pressure which is larger by the ratio of the cross sectional areas of the piston 35 and the expulsion piston 33' is established in the pre-storage chamber 31'. The igniter oil is thus injected into the combustion chamber 12 when the opening pressure of the igniter oil nozzle 15 is exceeded. Due to the large volumetric capacity of the pressure chamber 36 during a movement of the piston 35, the pressure in the alcohol system collapses, further showing the buildup of the opening pressure of the alcohol nozzle 14 or 14'. Thus, a relatively long time elapses between the injection points of the igniter oil and the main fuel. This is true even when the opening pressures of the igniter oil nozzle 15 and the alcohol nozzle 14 or 14' are approximately equal, which is desirable in principle. Accordingly, the differential piston 35 causes a pressure increase of the pre-stored igniter oil relative to the main fuel, and also amplifies the volumetric capacity of the system, as opposed to an expulsion piston having a constant diameter, such as depicted in FIG. 3.

Figure 5:
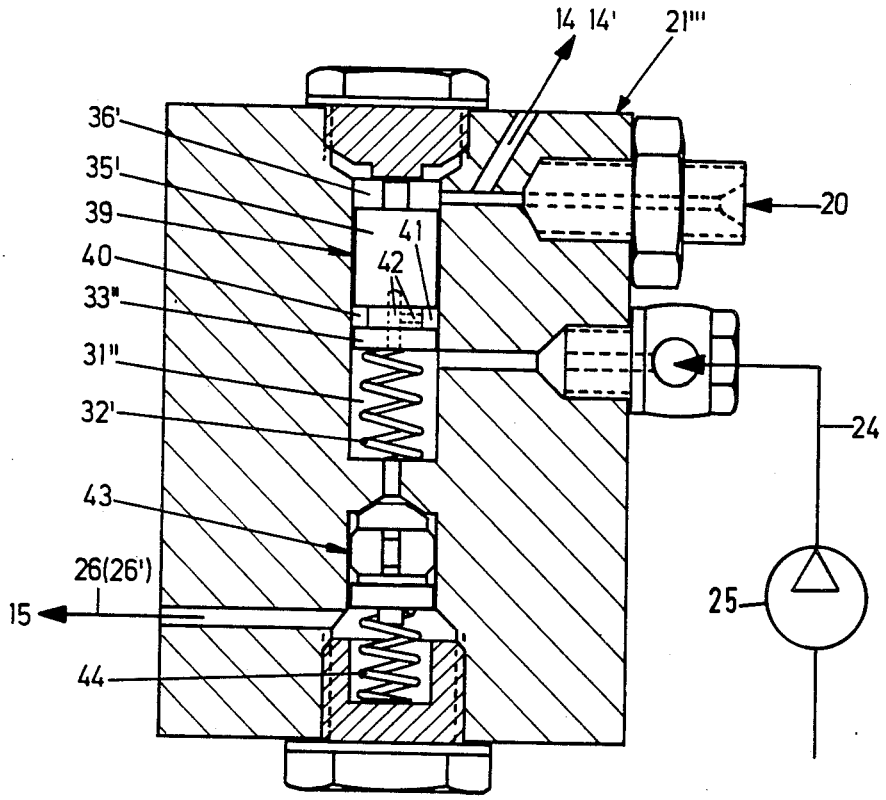
FIG. 5 shows a third embodiment of a pressure divider with an expulsion piston having a control edge.

FIG. 5 shows a pressure divider 21''' in which igniter oil is once again brought from the low pressure pump 25 to a pre-storage chamber 31'' via a supply line 24. The pre-storage chamber 31'' is closed by an axially displaceable feed piston 39 embodied at its end facing the pre-storage chamber 31'' as an expulsion piston 33''. The edge of the expulsion piston 33'' remote from the pre-storage-chamber 31'' serves as a control edge 40. A piston 35' which is a component part of the feed piston 39 is coupled to the expulsion piston 33''. The piston 35' has the same diameter as the expulsion piston 33'' and, in its turn, limits a pressure chamber 36' connected to the pressure side 20 of the injection pump. An annular overflow channel 41 is located between the piston 35' and the expulsion piston 33''; this channel is connected to the pre-storage chamber 31'' via corresponding overflow bores 42.

The feed piston 39 is brought into the rest position shown in the drawing by a spring 32' located in the pre-storage chamber 31, so that the pre-storage chamber 31'' can be filled with igniter oil from the low pressure pump 25. When the pressure of the main fuel becomes greater than the pre-storage pressure of the igniter oil, the feed piston 39 is moved toward the pre-storage chamber 31'' and the pre-stored igniter fuel is thereby expelled into the pressure line 26 or 26'. As the opening pressure of the igniter oil nozzle 15 is reached, the igniter oil is injected into the combustion chamber 12. At the beginning of this expulsion process, the expulsion piston 33'' closes the supply line 24 leading into the pre-storage chamber 31'', and keeps it closed until the control edge 40 reaches the line 24. At that moment, the pre-storage chamber 31'' is short-circuited to the supply line 24 through the overflow bore 42 and through the annular overflow channel 41, so that the pressure built up in the pre-storage chamber 31'' can once again discharge into the low pressure system of the low pressure pump 25 and the line 24.

An equalizing relief valve 43 is located behind the pre-storage chamber 31'', and is opened against the pressure of a spring 44 during the expulsion of the igniter oil from the pre-storage chamber 31''; the valve 43 closes very rapidly during the above-mentioned pressure relief produced by the control edge 40. Accordingly, the igniter fuel is injected very rapidly and without post-injection, because, at the beginning of the expulsion process, the relief valve opens only when the pressure of the pre-stored igniter fuel becomes so larger as to overcome the pre-tension force of the spring 44. In this embodiment too, a line connects the high-pressure alcohol system to the alcohol nozzle 14 or 14'.

Figure 7:
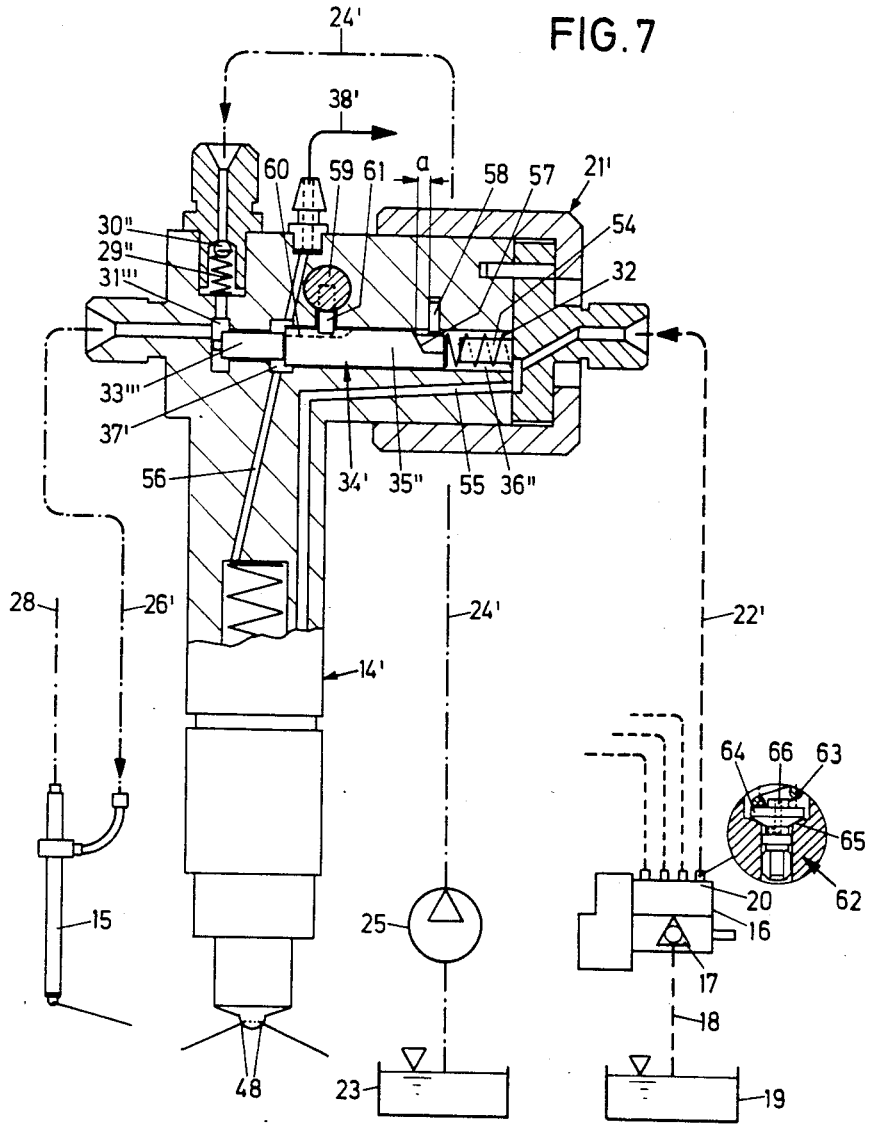
FIG. 7 is a sectional view of a further pressure divider according to the invention.

FIG. 7 shows an exemplary embodiment associated with FIG. 2. The igniter oil is brought by the low pressure pump 25 from the storage container 23 to the pressure divider 21'. When the pressure of the main fuel, i.e. of the alcohol, is lower than the pressure in the supply line 24', a check valve 30'', held closed by a spring 29'', opens and allows the igniter oil to flow into a pre-storage chamber 31'''. The pre-storage chamber 31''' is connected to the igniter oil nozzle 15 via an igniter oil pressure line 26.

An expulsion piston 33''' is axially displaceable in the pre-storage chamber 31'''. The piston 33''' forms the small piston of a differential piston 34'. The larger piston 35'' of the differential piston 34' is disposed coaxially to the expulsion piston 33''' and is fixedly attached thereto. The piston 35'' is located in a cylindrical pressure chamber 36'' having a corresponding cross-section. The pressure chamber 36'' is connected at its end remote from the expulsion piston 33''' to the pressure side 20 of the injection pump 16. the large piston 35'' is likewise acted on at this side by a pre-tension spring 32 held on a cylindrical filler piece 54 constructed integrally with the housing and serving to guide the spring 32 and also to reduce the volume in this part of the pressure chamber 36''. A shared leak oil line 38' leads out of the chamber 37' located between the large piston 35'' and the expulsion piston 33'''. Finally, a channel 55 branches off to the alcohol nozzle 14' from the pressure chamber 36'', in particular on the side where the pressure of the main fuel always prevails. A leak oil channel 56 coming from the alcohol jet 14' also leads into the chamber 37'. As already mentioned, the check valve 30'' opens when the (low) pressure in the supply line 24' is greater than the pressure in the main fuel line system. Igniter oil then flows into the pre-storage chamber 31''', and displaces the expulsion piston 33''' from its rest position shown in the drawing against the force of the spring 32, i.e. from left to right in FIG. 7.

When the piston 35'', and thus also the expulsion piston 33''', are displaced by the high pressure of the main fuel, the check valve 30'' closes and the igniter fuel present in the pre-storage chamber 31''' is transported to the igniter oil nozzle 15 through the line 26'. After complete injection of the igniter fuel, the pressure on the main fuel side continues to rise until the needle valve (not shown) in the alcohol nozzle 14' opens, thereby delivering the main fuel through the pressure line 22' and the channel 55 to the orifices 48 of the alcohol nozzle 14' and thus injecting it into the combustion chamber 12.

At the end of the differential piston 34' which is defined by the large piston 35'' there is formed a control edge 57 embodied in the form of a partial thread and serving to vary the quantity of igniter fuel to be placed in the pre-storage chamber 31'''. A stationary detent 58 serves as a stroke limiter in that the control edge abuts against the detent as the pre-storage chamber 31''' is filled with igniter oil, thus limiting the stroke of the differential piston 35'', and the quantity of igniter oil to be pre-stored. A control rod 59 transversely displaceable relative to the displacement axis of the differential piston 35'' is located in the pressure distributor 21'. A pin-like detent 61 extending into a longitudunal groove 60 in the large piston 35'' is attached to the control rod 59. By displacing the control rod 59, the differential piston is rotated and different points along the spiral control edge 57 are thereby brought to bear against the detent 58 so that the stroke "a" can be varied.

As the differential piston 35'' is displaced in the direction toward the detent 58 during the filling of the pre-storage chamber 31''' with igniter oil, the main fuel is expelled from the rear part of the pressure chamber 36'' and is pushed back into the pressure line 22'. In order to allow a return flow of this fuel to the suction side of the injection pump 16, a relief valve 62 is located at the pressure side of this pump. The relief valve 62 is embodied in the form of a check valve opening against the pressure of a spring 63 as a result of fuel pressure in the injection pump 16; the valve 63 closes as a result of counterpressure from the direction of the pressure line 22'. A throttle channel 66, located in the valve body 64 of this relief valve 62 and bypassing the valve seat 65, throttles the main fuel flowing back to the suction side of the injection pump 16. The throttling also prevents fluctuations in the system of igniter oil and main fuel lines.

All of the illustrated exemplary embodiments will operate with an injection pump 16 driven by camshafts with compound cams, i.e. a main cam 46 and a pre-cam 47. The pre-cam 47 induces a pressure rise in the alcohol system, resulting in the injection of the pre-stored igniter oil without opening the alcohol nozzle 14 or 14'. This embodiment is shown in FIG. 1 by a dashed line.

Figure 6:
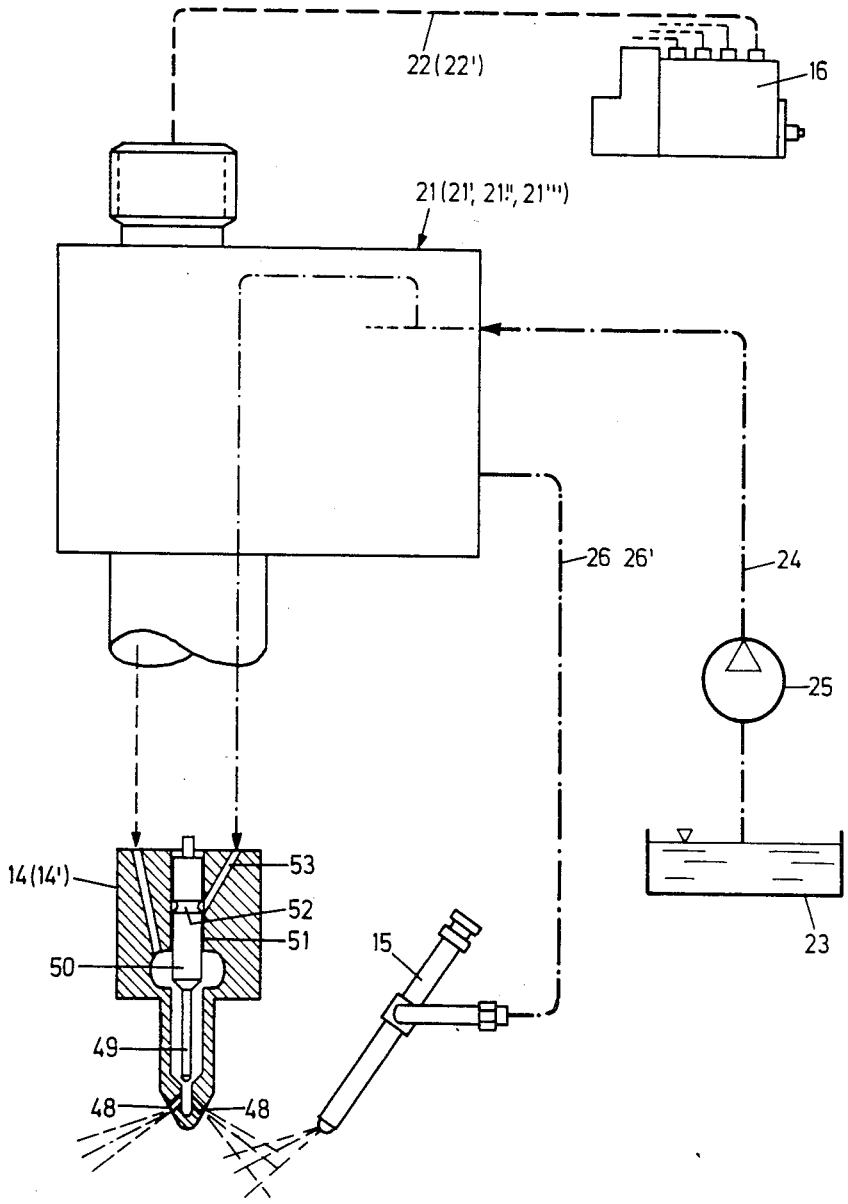
FIG. 6 illustrates lubrication of the alcohol injection nozzle by igniter fuel.

As suggested in FIGS. 1 and 2, and as best seen in FIGS. 6, and 7, multiple-orifice nozzles are employed as the main fuel injection nozzles 14 or 14', whereas a single-orifice nozzle is employed as the igniter oil nozzle 15.

FIG. 6 shows a possible embodiment of a lubrication device for the alcohol nozzle 14 or 14'. The nozzle 14 or 14' has a needle valve 49 for closing the orifices 48. The needle valve 49 is attached to a needle guide piston 50 axially displaceable in a close-fitting guide bore 51. A lubrication groove 52 in the needle guide piston 50 is filled with igniter fuel acting as lubricant oil, assuring sufficient lubrication between the needle guide piston 50 and the guide bore 51. The lubrication groove 52 is supplied with igniter fuel via a channel 53 to replace lost lubricant. For this purpose, the channel 53 in the pressure divider 21, 21', 21'', 21''' is connected to the igniter fuel supply line 24 upstream of the check valve 30 or 30' or the relief valve 43. The lubrication groove 52 is thus subjected to the pressure of the low-pressure igniter fuel pump 25 at least once during every working stroke of the needle valve 49.

The foregoing description relates to preferred but merely exemplary embodiments of the invention. Changes and variations may be made and features of one embodiment used in another, within the range of capabilities of a person skilled in the relevant art, without departing from the scope and spirit of the invention.

What is claimed is:

1. In a fuel injection system, especially for Diesel engines, having a high-pressure injection pump for injecting hard-to-ignite main fuel via at least one main fuel injection nozzle set to open at a given pressure and including a separate pump for the igniter fuel and at least one igniter fuel injection nozzle arranged behind the separate pump and also set to open at a given pressure, the improvement wherein said separate pump comprises a low-pressure pump (25), said low-pressure pump (25) being connected to a pre-storage chamber (31, 31', 31'', 31''') disposed in a pressure divider (21, 21', 21'', 21''') and including an expulsion piston (33, 33', 33'', 33''') operatively associated with said pre-storage chamber (31, 31', 31'', 31''') and arranged to be actuated by the pressure of the main fuel.

2. An improved system according to claim 1, wherein said expulsion piston (33') is part of a differential piston (34), the cross-sectional area of said expulsion piston (33') being smaller than the cross-sectional area of a further piston (35) which is also part of said differential piston (34) and is subjectable to the pressure of the main fuel.

3. An improved system according to claim 1, wherein the expulsion piston (33'') is part of a feed piston (39) and is provided with a control edge (40).

4. An improved system according to claim 1, including a relief valve (43) located downstream of said pre-storage chamber (31'').

5. An improved system according claim 1, including a high-pressure main fuel injection pump driven by a camshaft with compound cams each of which has a pre-cam (47) located ahead of a main cam (46).

6. An improved system according to claim 1, in which said main fuel injection nozzle has a lubricated guide bore for guiding a valve needle, said guide bore (51) being coupled to said second low pressure igniter fuel pump (25) via a channel (53).

7. An improved system according to claim 6, wherein said channel (53) is located in said pressure divider (21, 21', 21'', 21''').

8. An improved system according to claim 1, including means for adjusting the stroke (a) of said expulsion piston (33''').

9. An improved system according to claim 8, wherein said further piston (33''') has an operatively associated control edge (57) working in conjunction with a detent (58), where the maximum distance (a) between said control edge (57) and the detent (58) is variable.

10. An improved system according to claim 8, further comprising a control rod (59) for rotating said further piston (35'').

11. An improved system according to claim 8, further comprising a relief valve (62) upstream of a pressure chamber (36'') containing said further piston (35'').

12. An improved system according to claim 11, wherein said relief valve (62) is provided with a throttle channel for the main fuel.

13. A dual fuel injection system comprising a main fuel injection nozzle, said main fuel nozzle including means to set said main fuel nozzle to open at a first predetermined pressure, a relatively high pressure pump, means to connect said high pressure pump to said main fuel nozzle for delivering main fuel to said main fuel nozzle, an igniter fuel injection nozzle, said igniter fuel nozzle including means to set said igniter fuel nozzle to open at a second predetermined pressure, said main fuel being relatively harder to ignite than said igniter fuel, a relatively low pressure pump, a pressure divider located upstream of both and main fuel nozzle and said igniter fuel nozzle, said pressure divider comprising pre-storage chamber means for said igniter fuel and expulsion piston means cooperative with said pre-storage chamber means, means to store a predetermined quantity of said igniter fuel in said pre-storage chamber means, said expulsion piston means being adapted to expel said predetermined quantity of said igniter fuel stored in said pre-storage chamber means, means to connect said low pressure pump to said pre-storage chamber means and to said igniter fuel nozzle, and said means to connect said high pressure pump to said main fuel nozzle comprising means to deliver said high pressure main fuel from said high pressure pump to said pressure divider and to expose said expulsion piston means to the relatively high pressure of said main fuel exiting said high pressure pump to thereby expel said predetermined quantity of igniter fuel stored in said pre-storage chamber means out of said pre-storage chamber means and to deliver it to said igniter fuel injection nozzle.

* * * * *